United States Patent [19]

Klimpel et al.

[11] Patent Number: 4,684,459

[45] Date of Patent: Aug. 4, 1987

[54] COLLECTOR COMPOSITIONS FOR THE FROTH FLOTATION OF MINERAL VALUES

[75] Inventors: Richard R. Klimpel; Robert D. Hansen, both of Midland, Mich.

[73] Assignee: The Dow Chemical Company, Midland, Mich.

[21] Appl. No.: 856,728

[22] Filed: Apr. 28, 1986

Related U.S. Application Data

[63] Continuation-in-part of Ser. No. 803,026, Nov. 29, 1985, abandoned, which is a continuation-in-part of Ser. No. 787,199, Oct. 15, 1985, abandoned, which is a continuation-in-part of Ser. No. 649,890, Sep. 13, 1984, abandoned.

[51] Int. Cl.[4] ..... B03D 1/02

[52] U.S. Cl. ..... 209/166; 252/61; 558/232; 558/252; 558/253; 558/256; 564/501

[58] Field of Search ..... 252/61; 209/166, 167; 558/232, 252, 253, 256; 564/501

[56] References Cited

U.S. PATENT DOCUMENTS

| | | | |
|---|---|---|---|
| 1,833,740 | 11/1931 | Derby et al. | 252/61 |
| 2,011,176 | 8/1935 | Keller | 209/166 |
| 2,070,634 | 2/1937 | Werntz | 558/244 |
| 2,185,591 | 1/1940 | Jayne, Jr. | 252/9 |
| 2,501,269 | 3/1950 | Fischer | 209/166 |
| 2,691,635 | 10/1954 | Harris et al. | 252/61 |
| 2,769,839 | 11/1956 | Fincke | 564/501 |
| 4,066,681 | 1/1978 | Wachter | 558/232 |
| 4,086,273 | 4/1978 | Berazosky et al. | 564/501 |
| 4,326,067 | 4/1982 | Fazio | 548/347 |
| 4,526,696 | 7/1985 | Delourme et al. | 252/61 |

FOREIGN PATENT DOCUMENTS

| | | | |
|---|---|---|---|
| 1105156 | 7/1981 | Canada | 252/61 |

*Primary Examiner*—Robert A. Wax

[57] ABSTRACT

A collector composition for use in froth flotation processes comprises two collectors. One of the collectors is preferably an omega-(hydrocarbylthio)alkylamine, S-(omega-aminoalkyl) hydrocarbyl thioate, N-(hydrocarbyl)-alpha, omega-alkanediamine, (omega-aminoalkyl) hydrocarbon amide, omega-(hydrocarbyloxy)alkylamine, omega-aminoalkyl hydrocarbonoate or mixture thereof. The second collector is a thiocarbonate, a thionocarbamate, a thiophosphate, thiocarbinilide, thiophosphinate, mercaptan, xanthogen formate, xanthic ester or mixture thereof. The collector composition floats a broad range of metal-containing minerals.

23 Claims, No Drawings

COLLECTOR COMPOSITIONS FOR THE FROTH FLOTATION OF MINERAL VALUES

CROSS-REFERENCE TO RELATED APPLICATIONS

This application is a continuation-in-part of copending application Ser. No. 803,026, filed Nov. 29, 1985, which is a continuation-in-part of copending application Ser. No. 787,199, filed Oct. 15, 1985 which is a continuation-in-part of copending application Ser. No. 649,890, filed Sept. 13, 1984, all of which are now abandoned.

BACKGROUND OF THE INVENTION

This invention relates to compositions useful as collectors for the recovery of metal-containing mineral from ores by froth flotation.

Flotation is a process of treating a mixture of finely divided mineral solids, e.g., a pulverulent ore, suspended in a liquid whereby a portion of such solids is separated from other finely divided mineral solids, e.g., clays and other like materials present in the ore, by introducing a gas (or providing a gas in situ) in the liquid to produce a frothy mass containing certain of the solids on the top of the liquid, and leaving suspended (unfrothed) other solid components of the ore. Flotation is based on the principle that introducing a gas into a liquid containing solid particles of different materials suspended therein causes adherence of some gas to certain suspended solids and not to others and makes the particles having the gas thus adhered thereto lighter than the liquid. Accordingly, these particles rise to the top of the liquid to form a froth. The phenomena which renders flotation a particularly valuable industrial operation appear to be largely associated with the selective affinity of the surface of particulated solids, suspended in a liquid containing entrapped gas, for the liquid on the one hand, the gas on the other.

Various flotation agents have been admixed with the suspension to improve the frothing process. Such added agents are classed according to the function to be performed and include collectors such as xanthates, thionocarbamates and the like; frothers which facilitate the forming of a stable froth such as natural oils, e.g., pine oil and eucalyptus oil; modifiers such as activators, e.g., copper sulfate, to induce flotation in the presence of a collector; depressants, e.g., sodium cyanide, which tend to prevent a collector from functioning as such on a mineral which it is desired to retain in the liquid and thereby discourage a substance from being carried up and forming a part of the froth; pH regulators to produce optimum metallurgical results, e.g., lime, soda ash and the like. The specific additives used in a flotation operation are selected according to the nature of the ore, the mineral sought to be recovered and the other additives which are to be used in combination therewith.

Flotation is employed in a number of mineral separation processes including the selective separation of such metal-containing minerals as those containing copper, zinc, lead, nickel, molybdenum and other metals from sulfide minerals containing primarily iron, e.g., pyrite and pyrrhotite.

The conversion of metal-containing minerals to the more useful pure metal state, is often achieved by smelting processes. Such smelting processes can result in the formation of volatile sulfur compounds. These volatile sulfur compounds are often released to the atmosphere through smokestacks, or are removed from such smokestacks by expensive and elaborate scrubbing equipment. Many nonferrous metal-containing minerals are formed naturally in the presence of sulfide minerals containing primarily iron, such as pyrite and pyrrhotite. When the iron-containing sulfide minerals are recovered in flotation processes along with the nonferrous metal-containing sulfide minerals and sulfidized metal-containing oxide minerals, there is excess sulfur present which is released in the smelting processes. Therefore, processes which selectively recover the nonferrous metal-containing minerals while minimizing the recovery of the sulfide minerals containing primarily iron are desired.

Among others, collectors commonly used for the recovery of the metal-containing sulfide mineral ores or sulfidized metal-containing oxide minerals are xanthates, dithiopbosphates, and thionocarbamates. Unfortunately, the xanthates, thionocarbamates, and dithiophosphates are not particularly selective in the recovery of nonferrous metal-containing sulfide minerals in the presence of sulfide minerals containing primarily iron. In addition, these collectors are generally not of a commercially acceptable quality in the recovery of oxide-containing mineral values.

Of the other collectors, the mercaptan collectors are very slow kinetically in the flotation of metal-containing sulfide minerals and the disulfides and polysulfides give relatively low recoveries with slow kinetics. Therefore, the mercaptans, disulfides, and polysulfides are not generally used commercially. Furthermore, the mercaptans, disulfides and polysulfides are again not particularly selective in the recovery of non-ferrous metal-containing sulfide minerals in the presence of sulfide minerals containing primarily iron.

In view of the foregoing, collectors which are useful for the recovery, at relatively good recovery rates and selectivies, of a broad range of metal-containing minerals from mineral ores, particularly metal-containing minerals from ores in the presence of sulfide minerals containing primarily iron are desired.

SUMMARY OF THE INVENTION

The present invention, in one aspect, is a composition comprising (a) a compound corresponding to the formula:

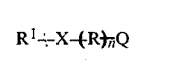

$$R^1-X-(R)_nQ \qquad (I)$$

where $-(R)_n-$ is

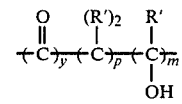

where each R′ is independently hydrogen, methyl or ethyl, $y+p+m=n$, n is an integer from 1 to 6; y, p and m are independently 0 or an integer from 1 to 6 and each moiety can occur in random sequence; $R^1$ is a $C_{1-22}$ hydrocarbyl or a $C_{1-22}$ substituted hydrocarbyl; X is —S—, —O—, $$-\overset{R^3}{\overset{|}{N}}-,\ -\overset{O}{\overset{\|}{C}}-S-,\ -\overset{O}{\overset{\|}{C}}-\overset{R^3}{\overset{|}{N}}-,\ \text{or}\ -\overset{O}{\overset{\|}{C}}O-;$$

$R^3$ is hydrogen, a $C_{1-22}$ hydrocarbyl or a $C_{1-22}$ substituted hydrocarbyl; and Q is:

$-N(R^2)_a(H)_b$ where a+b equals 2 and $R^2$ is a $C_{1-22}$ hydrocarbyl or $C_{1-22}$ substituted hydrocarbyl, —N=Y where Y is S, O, a hydrocarbylene radical or a substituted hydrocarbylene radical, —C≡N, or

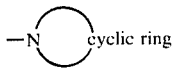

where the cyclic ring is saturated or unsaturated and may contain additional heteroatoms, such as oxygen or sulfur or additional nitrogen atoms; and (b) a thiol compound selected from the group consisting of a thiocarbonate, thionocarbamate, thiocarbanilide, thiophosphate, thiophosphinates, mercaptan, xanthogen formate, a xanthic ester and mixtures thereof.

In another aspect, the invention also resides in a method for recovering metal-containing minerals from an ore which comprises subjecting the ore, in the form of an aqueous pulp, to a froth flotation process in the presence of a flotation collector under conditions such that the metal-containing mineral(s) are recovered in the froth, wherein the collector comprises the above-described composition.

The compositions of this invention are capable of floating a broad range of metal-containing minerals including metal-containing sulfide minerals, metal-containing oxide minerals, sulfidized metal-containing oxide minerals and metals occurring in the metallic state (all four mineral groups being referred to herein as metal-containing minerals) from ores by froth flotation. The collector compositions of the present invention provide higher recoveries and selectivity towards the desired mineral than can be achieved with the use of either collector component alone, particularly in the recovery of nonferrous metal-containing minerals and a higher selectivity toward such nonferrous metal-containing minerals when such metal-containing minerals are found in the presence of sulfide minerals containing primarily iron.

DETAILED DESCRIPTON OF THE INVENTION

Component (a) of the composition of this invention is a component having structural formula (I). Although not specifically set forth in formula (I), in aqueous medium of low pH, preferably acidic, component (a) can exist in the form of a salt. In this formula, $\text{-}(R)_n\text{-}$ is advantageously $\text{-}(CH_2)_p\text{-}$, $$\text{-}(\overset{H}{\underset{OH}{C}})_m\text{-},\ \text{-}(\overset{O}{\overset{\|}{C}})_y\text{-}$$

or mixtures thereof, preferably $\text{-}(CH_2)_p$ or $$\text{-}(\overset{H}{\underset{OH}{C}})_m\text{-},$$

more preferably $\text{-}(CH_2)_p\text{-}$, wherein $p+m+y=n$ and n is an integer from 1 to 6, preferably from 1 to 4, most preferably 2 or 3. $R^1$ and each $R^2$ are advantageously a $C_{1-22}$ hydrocarbyl or a $C_{1-22}$ hydrocarbyl substituted with one or more hydroxy, amino, phosphonyl, alkoxy, halo, ether, imino, carbamyl, carbonyl, thiocarbonyl, cyanocarboxyl, hydrocarbylthio, hydrocarbyloxy, hydrocarbylamino or hydrocarbylimino groups. If substituted, $R^1$ or $R^2$ is advantageously substituted with one or more hydroxy, carbonyl, amino, phosphonyl or alkoxy moieties. Q is preferably $-N(R^2)_a(H)_b$ where a+b=2, preferably a is 0 or 1 and b is 1 or 2.

More advantageously, the carbon atoms in $R^1$ and $R^2$ total 6 or more, with $R^1$ preferably being a $C_{2-14}$ hydrocarbyl or a $C_{2-14}$ hydrocarbyl substituted with one or more hydroxy, amino, phosphonyl or alkoxy groups, more preferably a $C_{4-11}$ hydrocarbyl; and $R^2$ preferably being a $C_{1-6}$ alkyl, $C_{1-6}$ alkylcarbonyl or $C_{1-6}$-substituted alkyl group or alkylcarbonyl; more preferably a $C_{1-4}$ alkyl or $C_{1-4}$ alkylcarbonyl or a $C_{1-6}$ alkylcarbonyl substituted with an amino, hydroxy and phosphonyl group; and most preferably a $C_{1-2}$ alkyl or $C_{1-2}$ alkylcarbonyl. X is preferably —S—, $$-\overset{R^3}{\overset{|}{N}}-,$$

or —O—, more preferably —S— or $$-\overset{R^3}{\overset{|}{N}}-,$$

most preferably —S—; and $R^3$ is preferably hydrogen or $C_{1-14}$ hydrocarbyl, more preferably hydrogen or $C_{1-11}$ hydrocarbyl, most preferably hydrogen.

As described, the component (a) includes compounds such as the S-(omega-aminoalkyl)hydrocarbon thioates:

$$R^1-\overset{O}{\overset{\|}{C}}-S\text{-}(CH_2)_n\text{-}\underset{(H)_b}{\underset{|}{N}}\text{-}(R^2)_a; \qquad \text{(II)}$$

the omega-(hydrocarbylthio)alkylamines:

$$R^1-S\text{-}(CH_2)_n\text{-}\underset{(H)_b}{\underset{|}{N}}\text{-}(R^2)_a, \qquad \text{(III)}$$

which includes the omega-(hydrocarbylthio)alkylamides ($R^2$ is an alkylcarbonyl group, e.g., $$-\overset{O}{\overset{\|}{C}}-CH_3);$$

the N—(hydrocarbyl)-alpha,omega-alkanediamines:

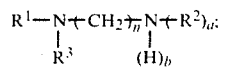

(IV)

the N—(omega-aminoalkyl)hydrocarbon amides:

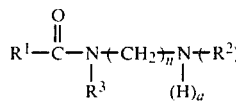

(V)

the omega-(hydrocarbyloxy-)alkylamines:

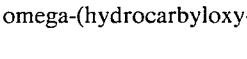

(VI)

and the omega-aminoalkyl hydrocarbonoates:

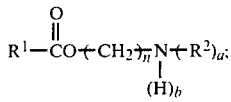

(VII)

wherein $R^1$, $R^2$, $R^3$, a, b and n are as hereinbefore defined. In formulas II–VII, when X is —S— or

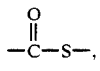

$R^1$ is preferably a $C_{4-10}$ hydrocarbyl; when X is

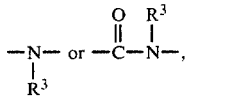

the total carbon content of the groups $R^1$ and $R^3$ is preferably between 1 and about 23, more preferably 2 and about 16, and most preferably 4 and about 15; and when X is

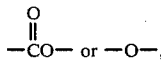

$R^1$ is most preferably $C_{6-11}$ hydrocarbyl.

Of the foregoing, the preferred component (a) compounds include omega-(hydrocarbylthio)alkylamines, N-(hydrocarbyl)-alpha,omega-alkanediamines, omega-(hydrocarbyloxy-)alkylamines, N-(omega-aminoalkyl)-hydrocarbon amides, or mixtures thereof. More preferred component (a) compounds include omega-(hydrocarbylthio)alkylamines, N-(hydrocarbyl)-alpha,omega-alkanediamines, N-(omega-aminoalkyl)-hydrocarbon amides, or mixtures thereof. The most preferred class of component (a) compounds are the omega-(hydrocarbylthio)alkylamines, including the omega-(hydrocarbylthio)alkylamides and mixtures of one or more omega-(hydrocarbylthio)alkylamines.

The omega-(hydrocarbylthio)alkylamines can be prepared by the processes disclosed in Berazosky et al., U.S. Pat. No. 4,086,273 (incorporated herein by reference); French Pat. No. 1,519,829 (incorporated herein by reference); and *Beilstein,* 4, 4th Ed., 4th Supp., 1655 (1979) (incorporated herein by reference). The (omega-aminoalkyl) hydrocarbon amides can be prepared by the processes described in Fazio, U.S. Pat. No. 4,326,067 (relevant parts incorporated herein by reference); *Acta Polon Pharm,* 19, 277 (1962) (incorporated herein by reference) and *Beilstein,* 4, 4th Ed., 3rd Supp., 587 (1962) (incorporated herein by reference). The omega-(hydrocarbyloxy)alkylamines can be prepared by the processes described in British Pat. No. 869,409 (relevant parts incorporated herein by reference); and Hobbs, U.S. Pat. No. 3,397,238 (incorporated herein by reference). The S-(omega-aminoalkyl)hydrocarbon thioates can be prepared by the processes described in Faye et al., U.S. Pat. No. 3,328,442 (incorporated herein by reference); and *Beilstein,* 4, 4th Ed., 4th Supp., 1657 (1979) (incorporated herein by reference). The omega-aminoalkyl hydrocarbonoates can be prepared by the process described in *J. Am. Chem. Soc.,* 83, 4835 (1961) (incorporated herein by reference); *Beilstein,* 4, 4th Ed., 4th Supp., 1413 (1979) (incorporated herein by reference); and *Beilstein,* 4, 4th Ed., 4th Supp., 1785 (1979) (incorporated herein by reference). The N-(hydrocarbyl)-alpha,omega-alkanediamines can be prepared by the process well-known in the art. One example is the process described in East German Pat. No. 98,510 (incorporated herein by reference).

The second component (b) of the collector composition of this invention is a thiol compound selected from the group consisting of thiocarbonate, a thionocarbamate, thiocarbanilide, a thiophosphate, thiophosphinates, mercaptan, xanthogen formate, xanthic ester and mixtures thereof.

Preferred thiocarbonates are the alkyl thiocarbonates represented by the structural formula:

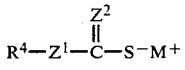

(VIII)

wherein each $R^4$ is independently a $C_{1-20}$, preferably $C_{2-16}$, more preferably $C_{3-12}$ alkyl group;

$Z^1$ and $Z^2$ are independently a sulfur or oxygen atom; and $M^+$ is an alkali metal cation.

The compounds represented by formula VIII include the alkyl thiocarbonates (both $Z^1$ and $Z^2$ are oxygen), alkyl dithiocarbonates ($Z^1$ is O, $Z^2$ is S) and the alkyl trithiocarbonates (both $Z^1$ and $Z^2$ are sulfur).

Examples of preferred alkyl monothiocarbonates include sodium ethyl monothiocarbonate, sodium isopropyl monothiocarbonate, sodium isobutyl monothiocarbonate, sodium amyl monothiocarbonate, potassium ethyl monothiocarbonate, potassium isopropyl monothiocarbonate, potassium isobutyl monothiocarbonate, and potassium amyl monothiocarbonate. Preferred alkyl dithiocarbonates include potassium ethyl dithiocarbonate, sodium ethyl dithiocarbonate, potassium amyl dithiocarbonate, sodium amyl dithiocarbonate, potassium isopropyl dithiocarbonate, sodium isopropyl dithiocarbonate, sodium sec-butyl dithiocarbonate, potassium sec-butyl dithiocarbonate, sodium isobutyl dithiocarbonate, potassium isobutyl dithiocarbonate, and the like. Examples of alkyl trithiocarbonates include sodium isobutyl trithiocarbonate and potassium isobutyl trithiocarbonate. It is often preferred to employ a mixture of an alkyl monothiocarbonate, alkyl dithiocarbonate and alkyl trithiocarbonate.

Preferred thionocarbamates correspond to the formula

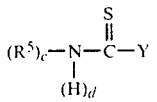

(IX)

wherein each $R^5$ is independently a $C_{1-10}$, preferably a $C_{1-4}$, more preferably a $C_{1-3}$, alkyl group;

Y is $—S^-M^+$ or $—OR^6$, wherein $R^6$ is a $C_{1-10}$, preferably a $C_{2-6}$, more preferably a $C_{3-4}$, alkyl group;

c is the integer 1 or 2; and d is the integer 0 or 1, wherein c+d must equal 2.

Preferred thionocarbamates include dialkyl dithiocarbamates (c=2, d=0 and Y is $S^-M^+$) and alkyl thionocarbamates (c=1, d=1 and Y is $—OR^6$). Examples of preferred dialkyl dithiocarbamates include methyl butyl dithiocarbamate, methyl isobutyl dithiocarbamate, methyl sec-butyl dithiocarbamate, methyl propyl dithiocarbamate, methyl isopropyl dithiocarbamate, ethyl butyl dithiocarbamate, ethyl isobutyl dithiocarbamate, ethyl sec-butyl dithiocarbamate, ethyl propyl dithiocarbamate, and ethyl isopropyl dithiocarbamate. Examples of preferred alkyl thionocarbamates include N-methyl butyl thionocarbamate, N-methyl isobutyl thionocarbamate, N-methyl sec-butyl thionocarbamate, N-methyl propyl thionocarbamate, N-methyl isopropyl thionocarbamate, N-ethyl butyl thionocarbamate, N-ethyl isobutyl thionocarbamate, N-ethyl sec-butyl thionocarbamate, N-ethyl propyl thionocarbamate, and N-ethyl isopropyl thionocarbamate. Of the foregoing, N-ethyl isopropyl thionocarbamate and N-ethyl isobutyl thionocarbamate are most preferred.

Thiophosphates useful herein generally correspond to the formula

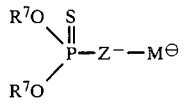

(X)

wherein each $R^7$ is independently hydrogen or a $C_{1-10}$ alkyl, preferably a $C_{2-8}$ alkyl, or an aryl, preferably an aryl group having from 6–10 carbon atoms, more preferably cresyl; Z is oxygen or sulfur; and M is an alkali metal cation.

Of compounds of the formula X, those preferably employed include the monoalkyl dithiophosphates (one $R^7$ is hydrogen and the other $R^7$ is a $C_{1-10}$ alkyl and Z is S), dialkyl dithiophosphates (both $R^7$ are $C_{1-10}$ alkyl and Z is S) and dialkyl monothiophosphate (both $R^7$ are a $C_{1-10}$ alkyl and Z is O).

Examples of preferred monoalkyl dithiophosphates include ethyl dithiophosphate, propyl dithiophosphate, isopropyl dithiophosphate, butyl dithiophosphate, sec-butyl dithiophosphate, and isobutyl dithiophosphate. Examples of dialkyl or aryl dithiophosphates include sodium diethyl dithiophosphate, sodium di-sec-butyl dithiophosphate, sodium diisobutyl dithiophosphate, and sodium diisoamyl dithiophosphate. Preferred monothiophosphates include sodium diethyl monothiophosphate, sodium di-sec-butyl monothiophosphate, sodium diisobutyl monothiophosphate, and sodium diisoamyl monothiophosphate.

Thiocarbanilides (dialkyl thioureas) are represented by the general structural formula:

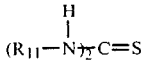

(XI)

wherein each $R_{11}$ is individually H or a $C_{1-6}$, preferably a $C_{1-3}$, hydrocarbyl.

Thiophosphinates are represented by the general structural formula:

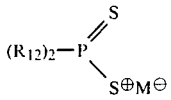

(XII)

wherein $M^{\oplus}$ is as hereinbefore described and each $R_{12}$ is independently an alkyl or aryl group, preferably an alkyl group having from 1 to 12, more preferably an alkyl group having from 1 to 8 carbon atoms. Most preferably, each $R_{12}$ is isobutyl.

Mercaptan collectors are preferably alkyl mercaptans represented by the general structural formula:

$$R_{13}—S—H \qquad \text{(XIII)}$$

wherein $R_{13}$ is an alkyl group, preferably an alkyl group having at least 10, more preferably from 10 to 16, carbon atoms.

Xanthogen formates are represented by the general structural formula:

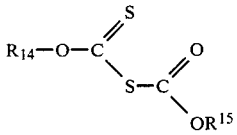

(XIV)

wherein $R_{14}$ is an alkyl group having from 1 to 7, preferably from 2 to 6 carbon atoms and $R_{15}$ is an alkyl group having 1 to 6, preferably 2 to 4, more preferably 2 or 3, carbon atoms.

Xanthic esters are preferably compounds of the general structural formula:

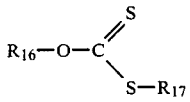

(XV)

wherein $R_{16}$ is an allyl group and $R_{17}$ is an alkyl group having from 1 to 7 carbon atoms.

Preferred compounds for use as component (b) herein are the thiocarbonates, thionocarbamates and the thiophosphates due to the surprisingly high recoveries and selectivities towards mineral values which can be achieved.

The composition of the present invention is prepared using sufficient amounts of component (a) and component (b) to prepare an effective collector for metal-containing mineral from ores in a froth flotation process. The amounts of each component most advantageously employed in preparing the composition will vary depending on the specific components (a) and (b) employed, the specific ore being treated and the desired rates of recovery and selectivity. The composition preferably comprises from about 10 to about 90, more preferably from 20 to 80, percent by weight, of component (a), and from about 10 to about 90, more preferably from 20 to 80, percent by weight, of component (b). The composition of this invention even more preferably comprises from about 30 to about 70 percent by weight of component (a) and from about 30 to about 70 percent by weight of component (b).

Within these compositional limitations, the amount of components (a) and (b) are selected such that the recovery of metal value in a froth flotation process is higher than either component could recovery at the same weight dosage.

A particularly preferred composition of the present invention comprises (a) an omega-(hydrocarbylthio)alkylamine, including an omega-(hydrocarbylthio)alkylamide, N-(hydrocarbyl)-alpha,omega-alkanediamine, N-(omega-aminoalkyl)hydrocarbon amide or mixtures thereof; and (b) an alkyl thiocarbonate which comprises an alkyl monothiocarbonate, alkyl dithiocarbonate or alkyl trithiocarbonate.

The composition and process of this invention are useful for the recovery by froth flotation of metal-containing minerals from ores. An ore refers herein to the metal as it is taken out of the ground and includes the metal-containing minerals in admixture with the gangue. Gangue refers herein to those materials which are of little or no value and need to be separated from the metal values.

Ores for which the composition and process are useful include sulfide mineral ores containing copper, zinc, molybdenum, cobalt, nickel, lead, arsenic, silver, chromium, gold, platinum, uranium and mixtures thereof. Examples of metal-containing sulfide minerals which may be concentrated by froth flotation using the composition and process of this invention include copper-bearing minerals such as covellite ($CuS$), chalcocite ($Cu_2S$), chalcopyrite ($CuFeS_2$), bornite ($Cu_5FeS_4$), valleriite ($Cu_2Fe_4S_7$ or $Cu_3Fe_4S_7$), tetrahedrite ($Cu_3SbS_2$), enargite ($Cu_3(As_2Sb)S_4$), tennantite ($Cu_{12}As_4S_{13}$), cubanite ($Cu_2SFe_4S_5$), brochantite ($Cu_4(OH)_6SO_4$), antlerite ($Cu_3SO_4(OH)_4$), famatinite ($Cu_3(SbAs)S_4$), and bournonite ($PbCuSbS_3$); lead-bearing minerals such as galena ($PbS$); anti-mony-bearing minerals such as stibnite ($Sb_2S_3$); zinc-bearing minerals such as sphalerite ($ZnS$); silver-bearing minerals such as stephanite ($Ag_5SbS_4$) and argentite ($Ag_2S$); chromium-bearing minerals such as daubreelite ($FeSCrS_3$); nickel-bearing minerals such as pentlandite [$(FeNi)_9S_8$]; molybdenum-bearing minerals such as molybdenite ($MoS_2$); and platinum- and palladium-bearing minerals such as cooperite [$Pt(AsS)_2$]. Preferred metal-containing sulfide minerals include molybdenite ($MoS_2$), chalcopyrite ($CuFeS_2$), galena ($PbS$), sphalerite ($ZnS$), bornite ($Cu_5FeS_4$), and pentlandite [$(FeNi)_9S_8$].

Sulfidized metal-containing oxide minerals are minerals which are treated with a sulfidization chemical, so as to give such minerals sulfide mineral characteristics, so the minerals can be recovered in froth flotation using collectors which recover sulfide minerals. Sulfidization results in oxide minerals having sulfide mineral characteristics. Oxide minerals are sulfidized by contact with compounds which react with the minerals to form a sulfur bond or affinity. Such methods are well-known in the art. Such compounds include sodium hydrosulfide, sulfuric acid and related sulfur-containing salts such as sodium sulfide.

Sulfidized metal-containing oxide minerals and oxide minerals for which this process is useful include oxide minerals containing copper, aluminum, iron, titanium, magnesium, chromium, tungsten, molybdenum, manganese, tin, uranium, and mixtures thereof. Examples of metal-containing minerals which may be concentrated by froth flotation using the process of this invention include copper-bearing minerals such as malachite ($Cu_2(OH)_2CO_3$), azurite ($Cu_3(OH)_2(CO_3)_2$), cuprite ($Cu_2O$), atacamite ($Cu_2Cl(OH)_3$), tenorite ($CuO$), chrysocolla ($CuSiO_3$); aluminum-bearing minerals such as corundum; zinc-containing minerals such as zincite ($ZnO$) and smithsonite ($ZnCO_3$); tungsten-bearing minerals such as wolframite [$(Fe_2Mn)WO_4$]; nickel-bearing minerals such as bunsenite ($NiO$); molybdenum-bearing minerals such as wulfenite ($PbMoO_4$) and powellite ($CaMoO_4$); iron-containing minerals such as hematite and magnetite; chromium-containing minerals such as chromite ($FeOCr_2O_3$); iron- and titanium-containing minerals such as ilmenite; magnesium- and aluminum-containing minerals such as spinel; titanium-containing minerals such as rutile; manganese-containing minerals such as pyrolusite; tin-containing ores, minerals such as cassiterite; and uranium-containing minerals such as uraninite, pitchblende ($U_2O_5(U_3O_8)$) and gummite ($UO_3nH_2O$).

Other metal-containing minerals for which this process is useful include gold-bearing minerals such as sylvanite ($AuAgTe_2$) and calaverite ($AuTe$); platinum- and palladium-bearing minerals such as sperrylite ($PtAs_2$); and silver-bearing minerals such as hessite ($AgTe_2$). Also included are metals which occur in a metallic state, e.g., gold, silver and copper.

In a preferred embodiment of this invention, copper-containing sulfide minerals, nickel-containing sulfide minerals, lead-containing sulfide minerals, zinc-containing sulfide minerals or molybdenum-containing sulfide minerals are recovered. In an even more preferred embodiment, a copper-containing sulfide mineral is recovered.

The collectors of this invention can be used in any concentration which gives the desired recovery of the desired metal values. In particular, the concentration used is dependent upon the particular mineral to be recovered, the grade of the ore to be subjected to the froth flotation process and the desired quality of the mineral to be recovered. Preferably, the collectors of this invention are used in concentrations of 5 grams (g) to 1000 g per metric ton of ore, more preferably between about 10 g and 200 g of collector per metric ton of ore to be subjected to froth flotation. In general, to obtain optimum synergistic behavior, it is most advantageous to begin at low dosage levels and increase the dosage level until the desired effect is achieved.

During the froth flotation process of this invention, the use of frothers is preferred. Frothers are well-known in the art and reference is made thereto for the purposes of this invention. Any frother which results in the recovery of the desired metal value is suitable. Frothers usful in this invention include any frothers known in the art which give the recovery of the desired mineral value. Examples of such frothers include $C_{5-8}$ alcohols, pine oils, cresols, $C_{1-4}$ alkyl ethers of polypropylene glycols, dihydroxylates of polypropylene glycols, glycols, fatty acids, soaps, alkylaryl sulfonates, and the like. Furthermore, blends of such frothers may also be used. All frothers which are suitable for beneficiation of mineral ores by froth flotation can be used in this invention.

In addition, in the process of this invention it is contemplated that the collector combination which makes up the composition of this invention can be used in mixtures with other collectors well-known in the art.

The collector composition of this invention may also be used with an amount of other collectors known in the art which give the desired recovery of mineral values. Examples of such other collectors useful in this invention include thiophosphonyl chlorides, mercapto benzothiazoles, fatty acids and salts of fatty acids, alkyl sulfuric acids and salts thereof, alkyl and alkaryl sulfonic acids and salts thereof, alkyl phosphoric acids and salts thereof, alkyl and aryl phosphoric acids and salts thereof, sulfosuccinates, sulfosuccinamates, primary amines, secondary amines, tertiary amines, quaternary ammonium salts, alkyl pyridinium salts, guanidine, and alkyl propylene diamines.

The following examples are included for the purposes of illustration only and are not to be construed to limit the scope of the invention or claims. Unless otherwise indicated, all parts and percentages are by weight.

In the examples, the performance of the frothing processes described is shown by giving the fractional amount of recovery at a specified time.

EXAMPLE 1

A series of samples of copper/nickel ore, containing chalcopyrite and pentlandite minerals, from Eastern Canada having a high amount of iron sulfide in the form of pyrrhotite are drawn from feeders to plant rougher bank and placed in buckets. Each bucket holds approximately 1200 g of solid. The contents of each bucket which has a pH of about 9 are used to generate a series of time-recovery profiles using the various collectors set forth in Table I. The profiles are made using a Denver® cell equipped with an automated paddle and constant pulp level device. A frother and collector are added once with a condition time of one minute before froth removal is started. The dosage of the collectors is 0.028 kg/ton of flotation feed. A Dowfroth®1263 frother is also employed at a concentration of 0.0028 kg/ton. During the testing, individual concentrates are selected at 1, 3, 6 and 12 minutes for subsequent evaluation. The collected concentrates are dried, weighed, ground and statistically representative samples prepared for assay. Time-related recoveries and overall head grades are calculated using standard calculation procedures. Results are presented in Table I.

TABLE I

| Collector | Cu R-12[2] | Ni R-12[2] | Gangue R-12[2] | Pyrrhotite R-12[2] |
|---|---|---|---|---|
| sodium amyl xanthate[1] | 0.939 | 0.842 | 0.039 | 0.333 |
| ethyl 2-(hexylthio)-ethylamide[1] | 0.936 | 0.830 | 0.048 | 0.477 |
| ethyl 2-(hexylthio)-ethyl amide (75 weight percent) and sodium amyl xanthate (25 weight percent) | 0.942 | 0.880 | 0.068 | 0.391 |
| N,N—dibutyl-1,2-ethane diamine[1] | 0.926 | 0.849 | 0.042 | 0.473 |
| N,N—dibutyl-1,2-ethane diamine (75 weight percent) and sodium amyl xanthate (25 weight percent) | 0.957 | 0.883 | 0.062 | 0.466 |

TABLE I-continued

| Collector | Cu R-12[2] | Ni R-12[2] | Gangue R-12[2] | Pyrrhotite R-12[2] |
|---|---|---|---|---|
| nonyl N—(2-aminoethyl)amide[1] | 0.900 | 0.814 | 0.034 | 0.400 |
| nonyl N—(2-aminoethyl)-amide (75 weight percent) and sodium amyl xanthate (25 weight percent) | 0.937 | 0.872 | 0.037 | 0.369 |

[1]Not an example of the invention.
[2]R-12 is the fractional recovery after 12 minutes.

As evidenced by the data set forth in Table I, the composition of the present invention which comprises a collector combination results in superior recovery in the froth flotation process as compared to the froth flotation process using a single collector.

EXAMPLE 2

A series of uniform 1000-g samples of a complex Pb/Zn/Cu/Ag ore from Central Canada are prepared. The ore contains galena, sphalerite, chalcopyrite and argentite. For each flotation run, a sample is added to a rod mill along with 500 cubic centimeters of tap water and 7.5 milliliters of $SO_2$ solution. Six and one-half minutes of mill time are used to prepare the feed such that 90 percent of the ore has a particle size of less than 200 mesh (75 microns). After grinding, contents are transferred to a cell fitted with an automated paddle for froth removal, and the cell attached to a standard Denver® flotation mechanism.

A two-stage flotation is then performed—Stage I being a copper/lead/silver rougher and Stage II being a zinc rougher. To start the Stage I flotation, 1.5 g/kg of $Na_2CO_3$ is added (pH of 9 to 9.5), followed by the addition of the collector(s). The pulp is then conditioned for 5 minutes with air and agitation. This is followed by a 2-minute condition period with agitation only. A methyl isobutyl carbinol frother is then added (standard dose of 0.015 ml/kg). The concentrate is collected for 8 minutes of flotation and labeled as copper/lead rougher concentrate.

The Stage II flotation consists of adding 0.5 kg/metric ton of $CuSO_4$ to the cell remains of Stage I. The pH is then adjusted to 10.5 with lime addition. This is follwed by a condition period of 5 minutes with agitation only. The pH is then rechecked and adjusted back to 10.5 with lime. At this point, the collector(s) are added, followed by a five-minute condition period with agitation only. A methyl isobutyl carbinol frother is then added (standard dose of 0.020 ml/kg). Concentrate is collected for 8 minutes and labeled as zinc rougher concentrate.

The concentrate samples are dried, weighed, and appropriate samples prepared for assay using X-ray techniques. Using the assay data, fractional recoveries and grades are calculated using standard mass balance formulae. The results are compiled in Table II.

TABLE II

| Sample No. | Stage (Rougher) | Collector | Dosage (kg/t) | pH | Ag R-8 | Cu R-8 | Pb R-8 | Zn R-8 |
|---|---|---|---|---|---|---|---|---|
| A* | Cu/Pb | A + B | 0.007 + 0.009 | 9.5 | 0.463 | 0.332 | 0.264 | 0.026 |
| | Zn | A + C | 0.008 + 0.015 | 10.5 | 0.313 | 0.405 | 0.437 | 0.672 |

TABLE II-continued

| Sample No. | Stage (Rougher) | Collector | Dosage (kg/t) | pH | Ag R-8 | Cu R-8 | Pb R-8 | Zn R-8 |
|---|---|---|---|---|---|---|---|---|
| B* | Cu/Pb | D | 0.016 | 9.5 | 0.188 | 0.150 | 0.027 | 0.011 |
| | Zn | D | 0.023 | 10.5 | 0.615 | 0.457 | 0.806 | 0.866 |
| 1 | Cu/Pb | D + B | 0.007 + 0.009 | 9.5 | 0.549 | 0.444 | 0.288 | 0.035 |
| | Zn | D + C | 0.008 + 0.015 | 10.5 | 0.297 | 0.373 | 0.531 | 0.899 |

*Not an example of the present invention
Collector A - sodium ethyl xanthate
Collector B - dithiophosphate
Collector C - thionocarbamate
Collector D - $C_6H_{13}S(CH_2)_2NH_2$
R-8 is the actual fractional recovery after 8 minutes As evidenced by the data set forth in Tale II, a froth flotation process is effectively conducted using the composition of the present invention which comprises a combination of collectors of a specific type.

EXAMPLE 3

Uniform 500-g samples of copper oxide ore, containing malachite, from Western Australia are prepared as a slurry, previously adjusted to a pH of 10.4 by lime, using an Agitair 1500-ml cell. A series of initial floats (denoted as a Sulfide Float) are performed on these samples using the various collectors set forth in Table III at a dosage of 350 g/metric ton of ore. One minute of conditioning time is employed. The concentrate is removed for 3 minutes using a triethoxy butane frother as required. The recovered concentrate is then analyzed.

The remaining mineral slurry is then sulfidized by adding 500 g/ton of sodium hydrosulfide to the cell residue. Following this addition, there is a two-minute condition period. A series of subsequent floats (denoted as Oxide Floats) are performed on the sulfidized ore. A one-minute concentrate and a two- to five-minute concentrate are collected using a triethoxy butane frother as required. Twenty grams of the same collector as used in the Sulfide Float and 35 g of sodium hydrosulfide are added per ton of ore to the cell residue and conditioned for one minute. A five-minute concentrate is then collected. An additional 20 g of the same collector and 35 g of sodium hydrosulfide per ton of ore are added to the cell residue and conditioned for one minute. A five-minute concentrate is then collected. The collected concentrates and tails are dried, weighed and analyzed for total copper content using standard analytical techniques. The results are presented in Table III.

TABLE III

| Collector | Sulfide Float 3 minutes Cu Recovery | Oxide Float 15 minutes Cu Recovery | Oxide Float 15 minutes Cu Grade[2] | Total Float 18 minutes Cu Recovery |
|---|---|---|---|---|
| potassium amyl xanthate[1] | 0.178 | 0.670 | 0.227 | 0.484 |
| 2-(hexylthio)ethyl amine[1] | 0.155 | 0.681 | 0.146 | 0.836 |
| 2-(hexylthioethyl)amine and potassium amyl xanthate (both 50 weight percent) | 0.130 | 0.739 | 0.260 | 0.869 |
| ethyl 2-(hexylthio)ethyl amide[1] | 0.111 | 0.618 | 0.179 | 0.729 |
| ethyl 2-(hexylthio)ethyl amide and potassium amyl xanthate (both 50 weight percent) | 0.167 | 0.687 | 0.183 | 0.854 |

[1]Not an example of the invention
[2]Grade is the fractional content of the specified metal collected in the froth.

EXAMPLE 4

A large dry feed sample of nickel/cobalt ore, containing pentlandite and cobalt-containing mineral, from Western Australia is collected from which a series of test samples (750 grams) are prepared in slurry form. For the testing, an Agitair 1500-ml cell outfitted with a froth removal paddle is employed except for the final cleaner float which is done with a smaller cell and froth removed by hand. The flotation procedure employed consists of first adding 0.2 kg of $CuSO_4$ per metric ton of ore, conditioning the resulting mixture for 7 minutes, adding 0.1 kg/ton collector and conditioning for 3 minutes. The mixture is then transferred from the conditioning vessel to the cell. Subsequently, 0.14 kg of guar depressant (for talc) and 0.16 kg of collector per ton of ore and triethoxy butane frother as required to form a resonable froth bed is added. The concentrate is collected for 5 minutes. The rougher concentrate is then transferred to a smaller cell and 0.08 kg of collector and 0.14 kg of guar per ton of ore is added to the cell. The concentrate is collected for 3 minutes. The collector content is denoted as Cleaner Concentrate. The cell content is denoted as tails. Samples are filtered, dried prepared for assays, etc. Recoveries are calculated using standard metallurgical procedures. The results are compiled in Table IV.

TABLE IV

| Collector | Ni Rec Cleaner Concentrate[1] | Co Rec Cleaner Concentrate[1] | Ni Tails[2] | Co Tails[2] |
|---|---|---|---|---|
| sodium ethyl xanthate[3] | 0.642 | 0.687 | 0.071 | 0.099 |
| ethyl (2-hexylthio)ethylamide[3] | 0.738 | 0.698 | 0.080 | 0.110 |
| ethyl (2-hexylthio)ethylamide and sodium ethyl xanthate (50 weight percent of each) | 0.801 | 0.768 | 0.065 | 0.099 |

[1]Fractional recovery of metal at the end of the flotation run.
[2]Tails are the fraction of metal content remaining in cell after flotation.
[3]Not an embodiment of this invention.

What is claimed is:

1. A composition comprising (a) a compound corresponding to the formula:

$$R^1-X-(R)_n N(R^2)_a(H)_b$$

where $-(R)_n$ is

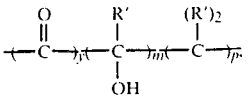

R′ is hydrogen, methyl or ethyl, y+p+m=n, n is an integer from 1 to 6 and each moiety can occur in random sequence; $R^1$ and $R^2$ are independently a $C_{1-22}$ hydrocarbyl or a $C_{1-22}$ substituted hydrocarbyl; X is —S— or

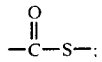

a is 0 or 1, b is 1 or 2 and $a+b=2$; and (b) a thiol compound selected from the group consisting of thiocarbonate, thionocarbamate, thiocarbanilide, thiophosphate, thiophosphinate, mercaptan, xanthogen formate, a xanthic ester and mixtures thereof.

2. The composition of claim 1 wherein y=0, m=0 and p is an integer from 1 to 6, $R^1$ is a $C_{2-14}$ hydrocarbyl or a $C_{2-14}$ hydrocarbyl substituted with one or more hydroxy, amino, phosphonyl, or alkoxy moieties and $R^2$ is a $C_{1-6}$ alkyl, $C_{1-6}$ alkylcarbonyl, or a $C_{1-6}$ alkyl or $C_{1-6}$ alkylcarbonyl group substituted with an amino, hydroxy or phosphonyl moiety.

3. The composition of claim 2 wherein component (b) is an alkyl thiocarbonate of the structural formula:

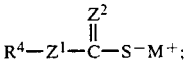

a thionocarbamate of the structural formula:

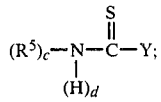

a thiophosphate of the structural formula:

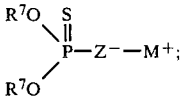

or mixtures thereof and $R^4$ is a $C_{1-20}$ alkyl group; each $R^5$ is independently a $C_{1-10}$ alkyl group; Y is $-S^-M^+$ or $-OR^6$; $R^6$ is a $C_{1-10}$ alkyl group; each $R^7$ is independently hydrogen, a $C_{1-10}$ alkyl group or an aryl group; $M^+$ is an alkali metal cation; Z, $Z^1$ and $Z^2$ are independently S or O; c is the integer 1 or 2; and d is the integer 0 or 1, with the proviso that the sum of c plus d equal 2.

4. The composition of claim 3 which comprises from about 10 to about 90 percent by weight of component (a) and from about 10 to about 90 percent by weight of component (b) wherein component (b) is selected from the group consisting of an alkyl thiocarbonate, thionocarbamate, thiophosphate or mixture thereof.

5. The composition of claim 4 which comprises from about 20 to about 80 percent by weight of component (a) and from about 20 to about 80 percent by weight of component (b).

6. The composition of claim 5 wherein $R^1$ is $C_{2-14}$ hydrocarbyl; $R^2$ is $C_{1-6}$ alkyl or $C_{1-6}$ alkylcarbonyl; $R^4$ is $C_{2-16}$ alkyl; $R^5$ is $C_{1-4}$ alkyl; $R^6$ is $C_{2-6}$ alkyl; $R^7$ is cresyl or $C_{2-8}$ alkyl; M is sodium or potassium; and n is an integer of from 1 to 4.

7. The composition of claim 6 wherein $R^1$ is $C_{4-11}$ hydrocarbyl; $R^2$ is $C_{1-4}$ alkyl or $C_{1-4}$ alkylcarbonyl; n is the integer 2 or 3; X is —S—, $R^4$ is $C_{3-12}$ alkyl; $R^5$ is $C_{1-3}$ alkyl; and $R^6$ is $C_{3-4}$ alkyl.

8. The composition of claim 7 wherein component (b) is an alkyl thiocarbonate.

9. The composition of claim 7 wherein component (b) comprises a mixture of an alkyl monothiocarbonate, alkyl dithiocarbonate and alkyl trithiocarbonate.

10. The composition of claim 7 wherein component (a) comprises an omega-(hydrocarbylthio)alkylamide.

11. The composition of claim 7 wherein component (a) is 2-(hexylthio)ethylamine or ethyl 2-(hexylthio)ethylamide.

12. A method of recovering metal from a metal ore which comprises subjecting the metal ore, in the form of an aqueous pulp, to a froth flotation process in the presence of a flotating amount of the flotation collector composition of claim 1.

13. The method of claim 12 wherein component (b) is an alkyl thiocarbonate corresponding to the structural formula:

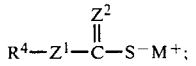

a thionocarbamate corresponding to the structural formula:

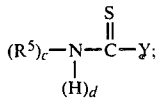

and a thiophosphate corresponding to the structural formula:

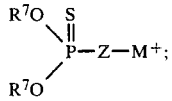

and $R^4$ is a $C_{1-20}$ alkyl group; each $R^5$ is independently a $C_{1-10}$ alkyl group; Y is $-S^-M^+$ or $OR^6$; $R^6$ is a $C_{1-10}$ alkyl group; each $R^7$ is independently hydrogen, a $C_{1-10}$ alkyl group or aryl group; M is an alkali metal cation; Z, $Z^1$ and $Z^2$ are independently S or O; c is the integer 1 or 2; and d is the integer 0 or 1, with the proviso that the sum of c plus d equal 2.

14. The method of claim 13 wherein the collector comprises from about 10 to about 90 percent by weight of component (a) and from about 10 to about 90 percent by weight of component (b) wherein component (b) is selected from the group consisting of an alkyl thiocarbonate, thionocarbamate, thiophosphate or mixture thereof.

15. The method of claim 14 wherein the collector comprises from about 20 to about 80 percent by weight of component (a) and from about 20 to about 80 percent by weight of component (b).

16. The method of claim 15 wherein $R^4$ is $C_{2-16}$ alkyl; $R^5$ is $C_{1-4}$ alkyl; $R^6$ is $C_{2-6}$ alkyl; $R^7$ is hydrogen or $C_{2-8}$ alkyl; and M is sodium or potassium.

17. The method of claim 16 wherein $R^4$ is $C_{3-12}$ alkyl; $R^5$ is $C_{1-3}$ alkyl; and $R^6$ is $C_{3-4}$ alkyl.

18. The method of claim 17 wherein component (b) is an alkyl thiocarbonate.

19. The method of claim 17 wherein component (b) comprises a mixture of an alkyl monothiocarbonate, alkyl dithiocarbonate and alkyl trithiocarbonate.

20. The method of claim 12 wherein a metal-containing sulfide mineral is recovered in the froth.

21. The method of claim 20 wherein the metal-containing sulfide mineral recovered in the froth contains copper, zinc, molybdenum, cobalt, nickel, lead, arsenic, silver, chromium, gold, platinum, uranium or mixture thereof.

22. The method of claim 21 wherein the metal-containing sulfide mineral recovered in the froth is molybdenite, chalcopyrite, galena, sphalerite, bornite, or pentlandite.

23. The method of claim 22 wherein the collector composition is present in a concentration of from about 0.001 kg of collector/ton to about 1.0 kg of collector/ton of feed to flotation.

* * * * *